United States Patent [19]

Stahlecker et al.

[11] 4,222,225

[45] Sep. 16, 1980

[54] OPEN END SPINNING MACHINE HAVING PIECING APPARATUS

[75] Inventors: Hans Stahlecker, Haldenstrasse 20, 7334 Suessen; Heinz Schulz, Schumannstrasse 10, 7332 Donzdorf, both of Fed. Rep. of Germany

[73] Assignees: Hans Stahlecker; Heinz Schulz, both of Fed. Rep. of Germany

[21] Appl. No.: 30,544

[22] Filed: Apr. 16, 1979

[30] Foreign Application Priority Data

Apr. 28, 1978 [DE] Fed. Rep. of Germany ..... 2818794

[51] Int. Cl.[3] ..... D01H 15/02; D01H 1/135

[52] U.S. Cl. ..... 57/263; 57/58.95

[58] Field of Search ..... 57/261–263, 57/58.89–58.95, 279

[56] References Cited

U.S. PATENT DOCUMENTS

| | | | |
|---|---|---|---|
| 3,962,855 | 6/1976 | Stahlecker | 57/263 |
| 3,987,610 | 10/1976 | Stahlecker et al. | 57/263 |
| 4,059,946 | 11/1977 | Bottcher et al. | 57/263 |
| 4,107,957 | 8/1978 | Stahlecker et al. | 57/263 |
| 4,150,530 | 4/1979 | Derichs | 57/263 |
| 4,156,341 | 5/1979 | Raasch | 57/263 |

*Primary Examiner*—John Petrakes

*Attorney, Agent, or Firm*—Craig and Antonelli

[57] ABSTRACT

An open-end spinning machine is provided which includes a plurality of commonly driven spinning units arranged in side-by-side relationship. Each of the spinning units includes a spinning rotor, an opening device for opening fibers, a fiber feed device for feeding fibers from the opening device to the spinning rotor, and vacuum producing means for generating an air current to act on the fibers to aid in the feeding through the fiber feed device. To accommodate start-up operations and restarting in the event of a shut-down spinning unit, piecing apparatus is provided which includes a thread end return device for returning a thread end into the rotor for piecing onto a fiber ring deposited inside of the rotor and for taking off the pieced thread. In preferred embodiments, the piecing apparatus is equipped with additional devices for controlling the rotor speed and the quantity of fibers fed during the piecing step. In order to enhance the control of the fiber feed during piecing operations, air flow control devices are provided for controlling the air current produced by the vacuum source device at the fiber feed device. In particularly preferred embodiments, the air flow control device includes selectively actuable venting sealing elements for selectively venting the vacuum applying lines and housing to atmosphere, to thereby slow down the effective rate of fiber feed.

12 Claims, 6 Drawing Figures

1
2
3
4
5
6
7
8
9
10
11
12
13
14
15
16
18
19
20
21
22
23
24
25
26
27
28
29
30
31
32
33
34
35
36
37
38
39
41
42
44
45
46
47
48
49
50
51
52
53
54
55
56
57
58
59
60
61
62
63
64
65
66
67
68
69
70
71
72
73
74
75
76
77
78
79
80
81
82
83
84
85
86

FIG. 4
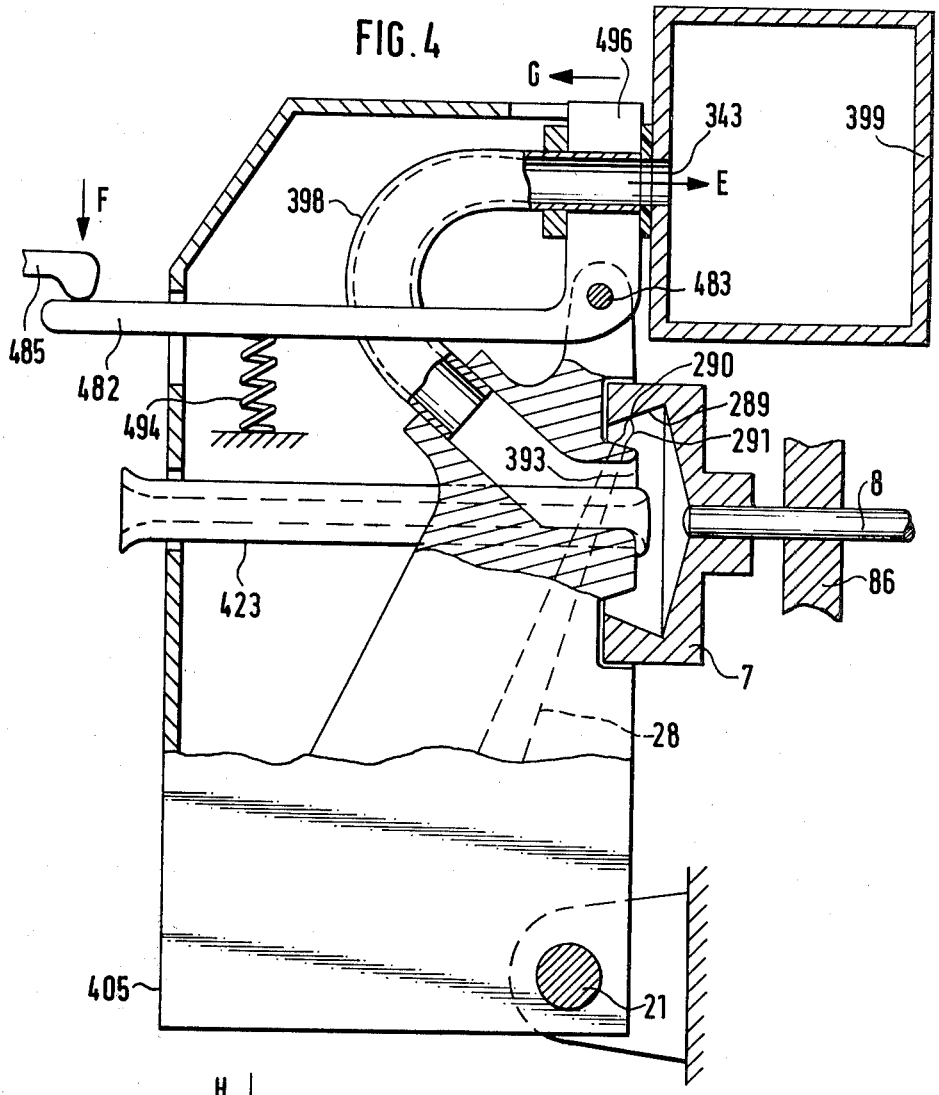
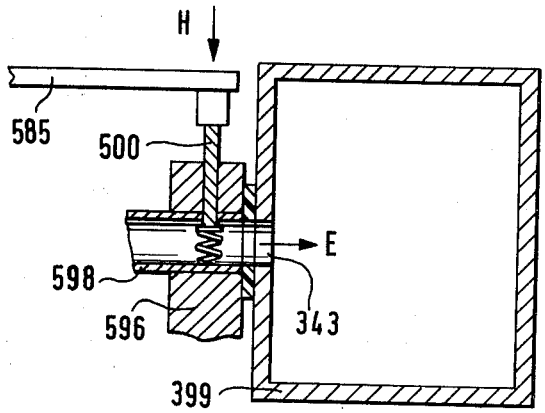
FIG. 5

OPEN END SPINNING MACHINE HAVING PIECING APPARATUS

BACKGROUND AND SUMMARY OF THE INVENTION

The invention relates to an open-end spinning machine with a plurality of spinning units, each containing a spinning rotor connected to a vacuum source. An air current is generated by the vacuum source to feed fibers fed by a feeding means and opened by an opening device to this spinning rotor. The invention further relates to apparatus for conducting a piecing step comprising devices for returning a thread end into the spinning rotor for piecing onto a fiber ring deposited therein and for taking off the thus-pieced thread, this apparatus being equipped with additional devices for affecting the rotor speed and the quantity of fed fibers during the piecing step.

As an aid to understanding the present invention, the following prior patents are incorporated herein by reference thereto: U.S. Pat. No. 3,892,062 (reissue application Ser. No. 812,411 filed July 1, 1977, now U.S. Pat. No. Re. 30,167); U.S. Pat. Nos. 3,924,393; 3,942,311; 3,950,926; 3,962,855; 3,987,610; and 4,059,946.

In an open-end spinning machine of the aforementioned type, it is known from U.S. Pat. No. 3,987,610 (corresponds to DOS [German Unexamined Published Application] No. 2,360,296) to effect the actual piecing operation, i.e. the return of the thread end, the attachment thereof to the fiber ring, and the taking off of the thus-pieced thread, within a time period wherein the previously braked spinning rotor is again returning to its operating speed. To make a piecing step possible at all, a fiber ring must have been deposited in the spinning rotor, to which the thread end can be pieced. To obtain this fiber ring, a certain amount of fibers must be fed into the spinning rotor. Within the spinning rotor, the fibers are retained in the zone of the fiber-collecting groove by centrifugal forces acting on the fibers. If the centrifugal forces are missing, i.e. when the rotor is at a standstill, or if the centrifugal forces are too low, i.e. when the spinning rotor runs at low speed, the fibers are entrained by the escaping conveying air from the rotor and removed by suction. To form the fiber ring from a specific quantity of fibers, feeding must therefore begin at a certain minimum speed; i.e. at a speed taking care of providing sufficient centrifugal force.

Under practical conditions, it was found that, in spite of maintaining all conditions most carefully, differing pieced thread sections are produced time and again, exhibiting deviations from other pieced thread sections with regard to tear strength and shape.

The invention is based on the problem of providing a possibility for refining the piecing operation so that uniform pieced thread sections are obtained with an even greater degree of certainty. The invention contemplates solving the mentioned problems by the provision of devices serving for affecting the air current, which latter effects the fiber transport from the opening device to the spinning rotor, during the piecing operation.

The invention starts with the realization that the speed of the air current and consequently also the velocity of the conveyed fibers depends practically exclusively on the vacuum [subatmospheric pressure] ambient within the spinning rotor. This feeding speed must be adapted, during normal operation, to the speed of the rotor so that the wall, upon which the fibers impinge, has a markedly higher velocity than the arriving fibers, so that the fibers, by entrainment along the wall of the spinning rotor, are drawn from the fiber feed duct and are thereby stretched and are deposited, in this stretched condition, on the wall of the rotor. These necessary velocity relationships, however, are not present in case the piecing operation is conducted at a reduced rotor speed. In this case, it happens that the fibers impinge with excessive speed on the rotor wall and are not drawn off therefrom but rather are crushed against the wall. In such case, they are then deposited in a tangled, irregular position, forming so-called "bird's nests". The invention provides that, during the piecing step, the air current can also be affected so that the transport velocities of the fibers can be adapted to the conditions existing during the piecing step.

These and further objects, features and advantages of the present invention will become more obvious from the following description when taken in connection with the accompanying drawings which show, for purposes of illustration, several embodiments in accordance with the present invention.

BRIEF DESCRIPTION OF THE DRAWINGS

FIG. 4 is a view similar to FIG. 2 and showing yet another preferred embodiment of the present invention;

FIG. 5 is a partial schematic detail view of a further preferred embodiment of air control apparatus in accordance with the present invention.

DETAILED DESCRIPTION OF THE DRAWINGS

Figure 1:
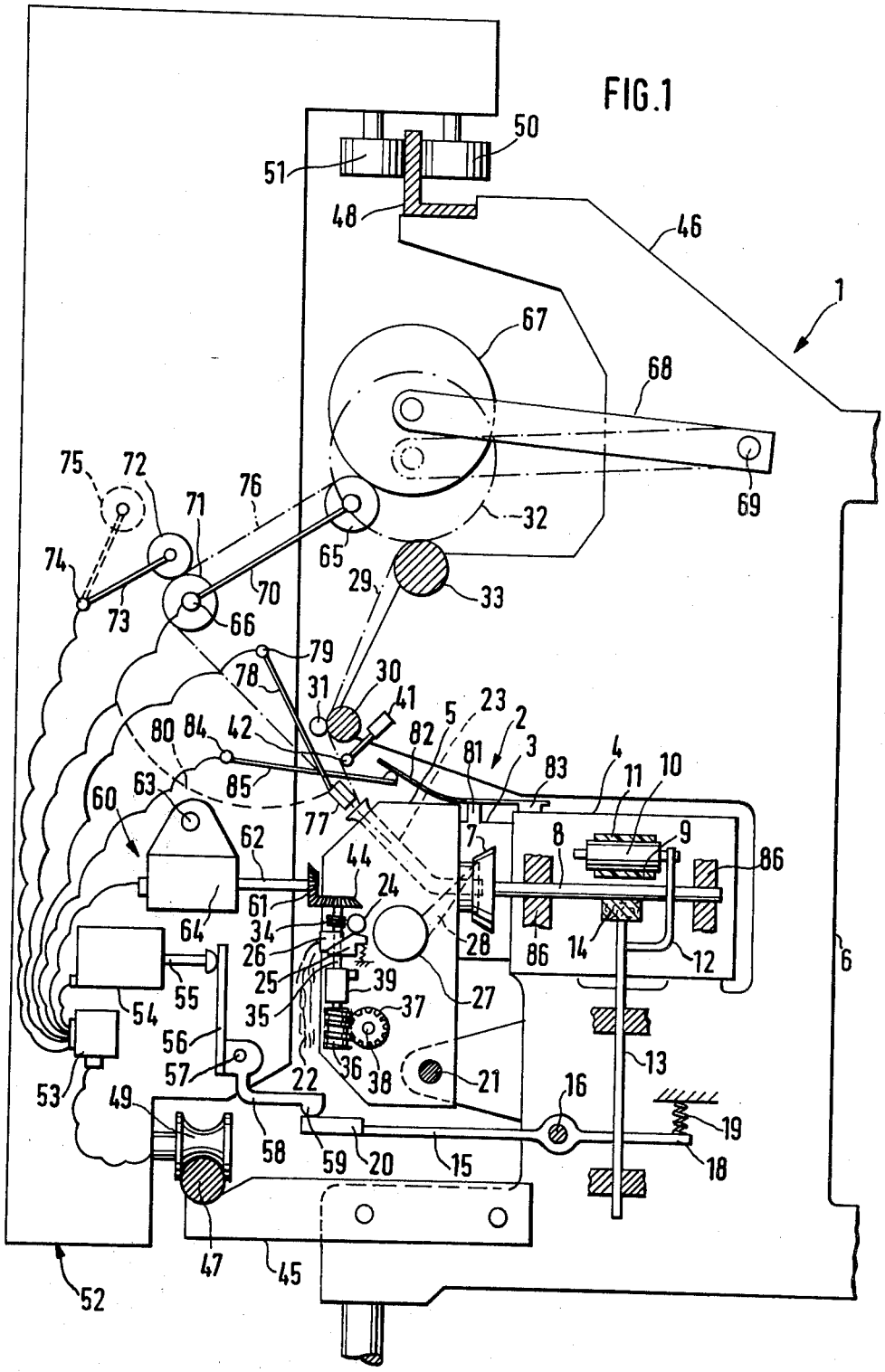
FIG. 1 is a sectional schematic view through an open-end spinning machine in the zone of an individual spinning unit and a mobile piecing apparatus, constructed in accordance with a preferred embodiment of the present invention.

FIG. 1 shows schematically a cross section through an open-end spinning machine 1 in the zone of a spinning unit 2, consisting of a plurality of such spinning units, arranged in side-by-side relationship. Each spinning unit 2 exhibits essentially three housings 3, 4 and 5 attached to a machine frame 6. The housing 3 is connected to a vacuum source and receives a spinning rotor 7. The shaft 8 of the spinning rotor 7 is supported by means of bearings 86 in the housing 4 and is driven, in the operating condition, by a tangential belt 9. This tangential belt 9 is pressed, in the operating condition, against the shaft 8 by means of a pressure roller 10, the latter also guiding the returning belt side 11 of the tangential belt 9. In the condition illustrated in FIG. 1, wherein the spinning rotor 7 is at a standstill, the pressure roller 10 and thus the driving tangential belt 9 are lifted off the rotor shaft 8. For this purpose, the pressure roller 10 is coupled via a linkage 12 with a braking mechanism 13 carrying a brake shoe 14; in FIG. 1 this brake shoe is in engagement with the rotor shaft 8. The braking mechanism 13 is coupled with a two-armed brake lever 15 pivotable about a fixed axle 16. In the operating condition, the rear arm 18 of the brake lever 15 is pressed downwardly by means of a spring 19, whereby the braking mechanism 13 is moved downwardly and thus lifts the brake shoe 14 of the rotor shaft 8. At the same time, due to a coupling of the linkage 12 with the braking mechanism 13, the pressure roller 10 is lowered so that the tangential belt 9 is in contact with the rotor shaft 8. The forward arm of the brake lever 15 comprises a pad 20, by means of which the entire braking mechanism can be operated.

A fixed axle 21 is mounted to the machine frame 6, the housing 5 of the spinning unit 2 being pivotable about this axle away from the housing 3. In this manner, the spinning rotor 7 can be uncovered, if desired, and can be made accessible from the outside. The pivotable housing 5 contains essentially the feeding and opening devices for a sliver 22 to be spun, as well as a yarn take-off duct 23. The feeding device comprises a feed roll 24, a feed table 25 under spring pressure cooperating therewith, and a feed funnel 26 for the sliver 22. The sliver 22 entering the unit, clamped between the feed roll 24 and the feed table 25 along a clamping or nip line, offers a fiber tuft to a rapidly running opening roll 27. The opening roll 27 opens the sliver into individual fibers which are fed via a fiber feed duct 28 to the spinning rotor 7 and spun at that location into a thread 29. The thus-spun thread 29, indicated in dot-dash lines, is drawn off from the thead take-off duct 23 by means of take-off rolls 30 and 31 and wound up on a bobbin 32, likewise shown in dot-dash lines, which bobbin is driven by a friction roll 33.

The feed roll 24 is driven by way of a gear wheel 34 connected to another gear wheel 36 via a shaft 35, the gear wheel 36 meshing with a gear wheel 37, which latter is connected to a driven shaft 38 extending in the longitudinal direction of the machine, for rotation with this shaft. Between the gear wheels 34 and 36, an electromagnetic clutch 39 is arranged, connected to a thread break detector 41 by way of an electrical line, not shown. The thread break detector 41 contains a thread sensor 42 monitoring the presence of the thread 29. In case of a thread break, the thread break detector 41 interrupts the drive of the feed roll 24 by way of the electromagnetic clutch 39, which latter, although the gear wheel 36 is still being driven, arrests the gear wheel 34 and thus the feed roll 24. A bevel gear 44 is additionally arranged on the shaft 35 of the drive mechanism for the feed roll 24; this bevel gear extends somewhat in the forward direction from the housing 5 and serves as a means for activating the feeding operation from the outside during a piecing step in a way to be described hereinbelow.

Guide rails 47 and 48 are held at the machine frame 6 by means of cantilevers 45 and 46 and extend in the longitudinal direction of the machine. A servicing device 52 can run on these guide rails 47, 48 on runners 49, 50 and 51 along the open-end spinning machine 1. The weight of the servicing device 52 is preferably borne by two runners 49, at least one of which is being driven. The runners 50 and 51 take care of stabilizing the servicing device in the horizontal direction.

The mobile servicing device 52 comprises means or functional elements for piecing purposes, preferably for mending a thread break, wherein merely a few of these means are illustrated in FIG. 1. The servicing device 52 contains, inter alia, a program control unit 53 electrically connected to the drive mechanism as well as to several individual drive units for the various devices. The program control unit also controls an actuating element 54, illustrated as a reciprocating piston magnet; the piston 55 of this element can contact a lever 56 arranged at the servicing device 52, this lever being pivotable about an axle 57. An operating arm 58 is connected to the lever 56 for rotation therewith; the projection 59 of this arm can actuate the front pad 20 of the braking mechanism of the spinning rotor 7. In the case illustrated in FIG. 1, the piston 55 of the actuating element 54 is extended, urging the lever 56 toward the right, whereby the projection 59 is moved downwardly. Thereby, the pad 20 of the braking lever 15 is pressed in the downward direction, bringing the brake shoe 14 in contact with the rotor shaft 8 and furthermore lifting the tangential belt 9 off the rotor shaft 8. The spinning rotor 7 is thus in the braked condition. Once, under the effect of the program control unit 53, the piston 55 of the actuating element 54 has moved back toward the lefthand side, the brake lever 15 can again move upwardly by the action of the spring 19, whereby the brake 14 releases the rotor shaft 8 and the tangential belt 9 comes again in contact with the rotor shaft 8. The actuating element 54, under control of program control 53, thus triggers the instant of starting for the initiation of the operation of the spinning rotor 7. In dependence thereon, all of the remaining devices which must commence functioning are then controlled by the program control unit 53.

As long as the thread sensor 42 indicates the absence of a thread 29, the feed roll 24 is at a standstill. The mobile servicing device 52 is provided with a drive mechanism 60 comprising a bevel gear 61, which latter can mesh with the aforementioned bevel gear 44 of the spinning unit 2. The bevel gear 61 is seated on a shaft 62, which can be driven in a predetermined fashion, optionally with interruptions, by means of a motor 64 pivotable about the axle 63. In this way, the feed roll 24 can be driven by the piecing device 52 as long as the thread sensor 42 has not as yet started up the feeding of fibers to the respective spinning unit. During times when the servicing device 52 does not execute a piecing operation, the bevel gear 61 is pivoted away in the upward direction.

The servicing device 52 furthermore contains a lift-off roll 65 which can be pivoted about an axle 66. The lift-off roll 65 can contact the bobbin 32 from below and lift the same off the friction roll 33 into a raised position (bobbin 67). The bobbin 67 is held by a bobbin holder 68 pivotable about an axle 69 affixed to the machine. The lift-off roll 65 is arranged at a lever 70, which latter carries additionally an auxiliary take-off roll 71 at its pivot axle 66. This take-off roll 71 can be driven together with the lift-off roll 65 preferably synchronously in both directions of rotation. The auxiliary take-off roll 71 cooperates with a pressure roller 72, which latter can be pivoted into a raised position 75 by way of a lever 73 about an axle 74. This raised position 75 makes it possible to insert, with the aid of a pivotable suction means, not shown, the thread end 75to be wound off the raised bottin 67 and to be pieced between the take-off rolls 71, 75. The pressure roll 75 subsequently assumes the position 72, whereby thread end 76 to be pieced is guided within the servicing device 52 and can be conducted back to the thread take-off duct 23. This is accomplished with the cooperation of a thread transfer gripper 77, the pivot arm 78 of which is rotatable about an axle 79. The thread transfer gripper 77 can pivot along the radius 80 indicated in dashed lines.

Before the thread end 76 is reintroduced into the spinning rotor 7 and can be withdrawn again as a newly spun thread 29, a ring of fibers must be deposited in the spinning rotor 7, to which ring the thread end 76 is attached. The production of this fiber ring is controlled by the drive mechanism 60 of the servicing device 52 during the piecing operation. This drive mechanism continues its operation until the thread sensor 42 of the thread break detector 41 has assumed its operating position and thus the device for feeding fiber material, pertaining to the respective spinning unit 2, has been switched on. The servicing unit 52 contains in most cases a number of further functional elements, serving to prepare the returned thread end prior to the actual piecing step and to effect subsequently a controlled transfer of the thread, which has been taken off again and is in motion, to the spinning unit. The program control unit 53 of the mobile servicing device 52 determines the sequence and progression of the individual process steps required for the piecing operation until the thread has been finally transferred back to the spinning unit.

Nowadays, open-end spinning machines operate at 70,000 r.p.m. and more. Since it makes no sense to effect a piecing operation at such high rotor velocities, the provision is made to operate at lower rotor speeds during piecing. In this connection, it is advantageous to exploit the circumstance that the spinning rotor 7, when increasing its operating speed from a previously braked condition, traverses a certain speed range which is particularly suitable for the piecing step. Since open-end spinning machines generally are constructed so that the spinning rotors 7 can be braked independently of the spinning rotors of the neighboring units, the only feature by which the servicing unit 52, utilizing this traversal of a suitable speed range, is influential on the structure of the open-end spinning unit 2 resides in that an activating possibility is provided for the braking mechanism 13 of the spinning rotor 7, and that the sliver feed is taken over by the drive mechanism 60 for a certain period of time. The function of the servicing apparatus 52 is, above all, independent of the type of drive means for the spinning rotor 7 and its bearings 86.

The program control unit 53 controls the deposition of a fiber ring within the spinning rotor 7 during the time it is started up. The feeding of the fibers forming this fiber ring can be effected only after the spinning rotor has reached a minimum speed, since otherwise the centrifugal forces acting on the fibers within the spinning rotor 7 are as yet insufficient for retaining the fibers in the spinning rotor 7. Very irregular pieced thread sections are obtained unless an exactly predetermined quantity of fibers forms the fiber ring necessary for the piecing step. The program control unit 53 regulates a certain preliminary feeding of the sliver 22 already prior to the actual instant of piecing.

As described in the foregoing, it is important that the speed of the thus-fed fibers has a value already during the preliminary feeding process which is smaller than the peripheral speed of the spinning rotor 7 at the respective point of impingement of the fibers. To attain this objective, the provision could be made to have the program control unit 53 regulate the bevel gear 44 such that it is driven by the auxiliary drive mechanism 60 only at a point in time when the spinning rotor 7, during its speed-increasing phase, has already reached a specific minimum speed. However, since the spinning rotor 7 increases its speed very rapidly, this method cannot be put into practice in all instances, since also for the subsequent operating steps only very brief time intervals are available. It is, therefore, advantageous to take care by the use of different measures of making the speed of the fibers fed to the unit lower than the velocity of the spinning rotor 7.

In the embodiment of FIG. 1, the program control unit 53 also regulates a lever 85 pivotable about an axle 84, this lever acting on the air system of the spinning unit at least during the preliminary feeding of fiber material at a speed of the spinning rotor 7 which is reduced as compared to the piecing speed. The lever 85 contacts from below a lever 82 affixed to the machine and fashioned, for example, as a leaf spring. This lever 82 is mounted to the housing 4 with a retaining means 83 and closes an aperture 81 of the vacuum housing 3 in the operative position. During the preliminary feeding of fibers into the spinning rotor 7, the lever 85 of the servicing device 52 temporarily lifts the lever 82, so that the aperture 81 of the vacuum housing 3 is uncovered. As a consequence, the pressure difference at the respective spinning unit 2 is temporarily reduced so that the air current entering the spinning rotor 7 through the fiber feed duct 28 and entraining the fibers is reduced in its velocity. This reduction must be so large, in this connection, that the instantaneous peripheral speed of the spinning rotor 7 is higher than the feeding velocity of the fibers during the preliminary fiber feeding step.

The air entering through aperture 81 additionally takes care, if the aperture is already uncovered when the spinning rotor 7 is at a standstill, of flushing already deposited fibers out of the spinning rotor 7 and passing them into the suction disposal unit. These fibers can be those carded out or torn off from the fiber tuft, in spite of a shut-down feeding device, when the opening roll 27 is still rotating. Due to the increased air flow through the spinning rotor 7, an enhanced cleaning effect is thus exerted shortly before the piecing step.

This process will be explained in greater detail below with reference to the somewhat modified embodiment of FIG. 2. The spinning rotor 7, the shaft 8 of which is supported in bearings 86, rotates in a vacuum housing 203. The housing 203 is connected via a suction duct 287 to a vacuum source, not shown, so that an air draft is produced in the direction of arrow C. A partial housing 205 can be pivoted away, in a manner described above, from the housing 203; this partial housing 205 contacts the housing 203 in the operative position, with the interconnection of a sealing means 288. This pivotable partial housing 205 contains a supporting member 296, which can also be pivoted, furthermore the fiber feed duct 28, the yarn take-off duct 23, as well as an actuating 282. This actuating lever 282 is pivotable, by means of a holder 292, about the axle 283 mounted to the housing 205 in correspondence with the direction of arrow B. During the operative position, a spring 294 takes care of bringing the lever 282 with a resilient pressure element 295 in contact with a tubular pipe 297 in an airtight fashion. An aperture 281 of the vacuum housing 203 terminates in the pipe 297. In the illustrated embodiment, the opening 281 is disposed relatively closely to the suction removal duct. If a more intense cleaning of the spinning rotor 7 is desired, it is advantageous to arrange the aperture 281 so that the spinning rotor is located between this aperture 281 and the suction take-off duct 282, or is even disposed in the zone lying in opposition to the open side of the spinning rotor.

In normal operation, the fibers 291, fed in the air current through the fiber feed duct 28, impinge at point 290 on the fiber-collecting surface 289 of the spinning rotor 7. Care must now be taken that the peripheral speed of the spinning rotor 7 at point 290 is higher, in any event, than the feeding velocity of the fibers 291, but at least higher than the velocity component of the fibers 291 oriented in the peripheral direction of the spinning rotor 7. This necessary speed difference is to be present already during the preliminary feeding of the fibers 291, which step takes place at a still reduced speed of the spinning rotor 7. For this purpose, the lever 282 can be pivoted for a short time in the direction of arrow A during the preliminary feeding of the fibers 291, whereby the contact member 295 is lifted off the pipe 297. As a consequence, a portion of the vacuum in the housing 203 is eliminated via aperture 281 during the preliminary feeding step, whereby the velocity of the fibers 291 is temporarily reduced. This reduction must have such a value that the peripheral speed of the point 290 of the spinning rotor 7 is higher than the velocity of the fibers fed thereto, so that in this way a stretching of the fibers impinging on the fiber-collecting surface 289 takes place. This, in turn, has the result that the dreaded formation of "bird's nests" is avoided. The lever 282 affixed to the machine is activated in the direction of arrow A by a lever 285, indicated only generally, pertaining to the servicing apparatus 52 not illustrated in FIG. 2.

The "secondary air" entering via aperture 281 furthermore has the effect that the fibers already deposited in the spinning rotor 7 before the preliminary feeding step are flushed away before the spinning rotor 7 is capable of retaining these fibers due to the action of centrifugal forces. The feared "bird's nests" are thus effectively prevented.

Figure 2:
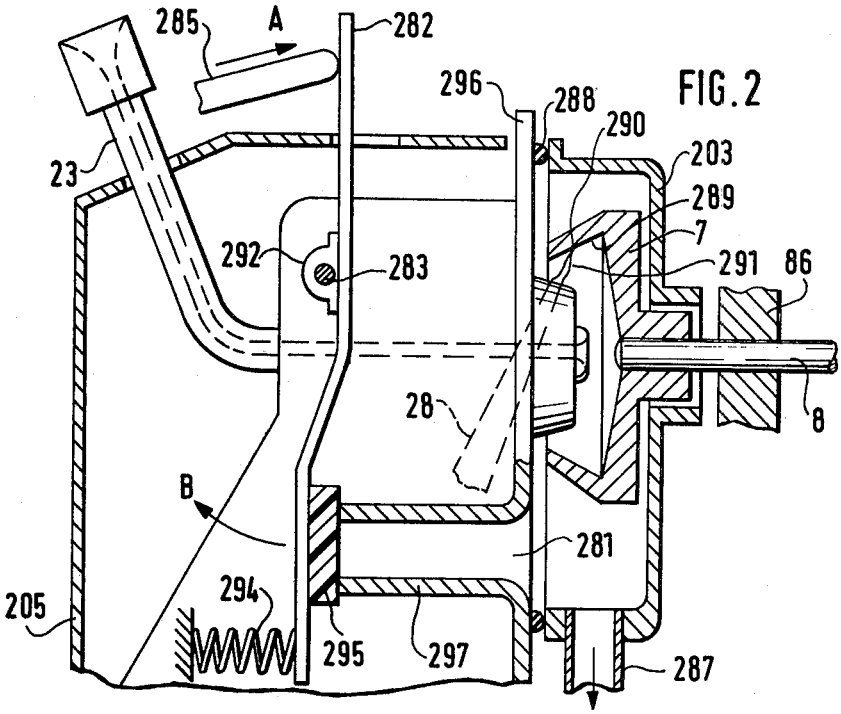
FIG. 2 is an enlarged partial sectional view of an open-end spinning unit and piecing apparatus constructed in accordance with a further preferred embodiment of the present invention.
Figure 3:
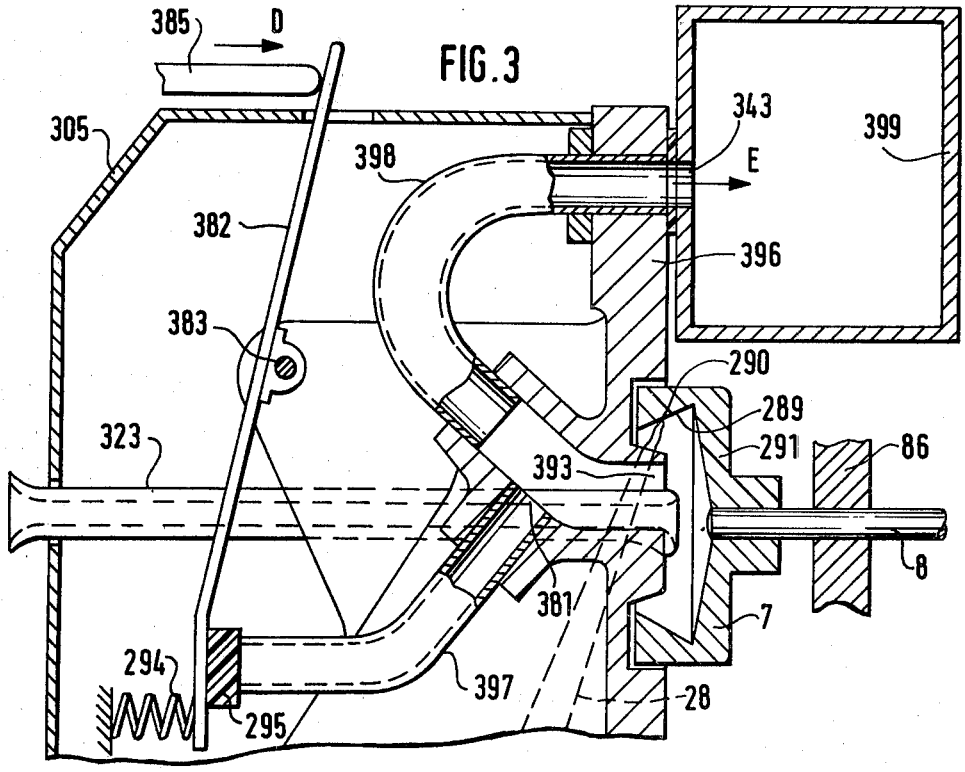
FIG. 3 is a view similar to FIG. 2 and showing yet another preferred embodiment of the present invention.

The components in FIG. 3 and the following figures similiar to the previous figures bear the same reference numerals. The embodiment according to FIG. 3 differs from the embodiment of FIG. 2 essentially in that the spinning rotor 7 does not rotate within a vacuum housing.

In the embodiment of FIG. 3, the pressure difference required for the air current is produced by removing the waste air via a suction duct 398 and a suction opening 393 directly from the interior of the spinning rotor 7. This preferably flexible suction duct 398, which after all is a component of the pivotable housing 305, terminates in an opening 343 (arrow E) of a vacuum channel 399 fixedly arranged in the machine. If necessary, the supporting member 396 can be pivoted, together with the suction duct 398, the yarn take-off duct 323, and the fiber feed duct 28, away from the fixedly arranged spinning rotor 7, together with the housing 305. The suction duct 398 has an aperture 381 to which a further duct pipe 397 is connected. This duct pipe 397 is sealed during the operation by means of the pressure element 295 of a pivotable lever 382 by the action of a compression spring 294. The lever 382 is pivotable about an axle 383 in a similar way as described in FIG. 2. Under the effect of an actuating lever 385, which pertains to the mobile servicing apparatus 52 and is movable in the direction of arrow D, the lever 382 with the pressure member 295 can release the duct pipe 397 for a short period of time. In this way, the vacuum is reduced for a short time via the aperture 381 already within the take-off duct 398, so that the fibers 291 during the preliminary feeding step here again have a lower speed than the peripheral speed of the fiber-collecting groove 289 at point 290.

The embodiment of FIG. 4 supplies the spinning rotor 7 with vacuum in a similar way as the device of FIG. 3, namely by way of a suction duct 398 beginning with an opening 393 in the interior of the spinning rotor 7 and terminating in the opening 343 of the machine-mounted suction duct 399. The difference as compared to the embodiment of FIG. 3 resides essentially in that by actuating the lever 482 against the compression spring 494 the aperture 343 is uncovered for a short time. The lever 482 is pivotable, for this purpose, about the axle 493 mounted to the housing 405 and passes over, past the point of articularion 483, into an elbow 496 serving as the mounting for the flexible suction duct 398. If the actuating lever 485 of the servicing apparatus 52 presses the lever 42 downwardly in the direction of arrow F, the upper elbow 496 of the lever 482 is pivoted toward the left according to the direction of arrow G, whereby the opening 343 of the intake duct 399 is temporarily uncovered. Due to this step, here again the vacuum in the spinning rotor 7 is reduced for a short period of time during the course of the preliminary feeding operation. The yarn take-off duct 423 is carried by the housing 405.

In the embodiment of FIG. 5, the suction take-off duct 598 retains its position during the preliminary feeding step, while the vacuum is reduced by the feature that a throttle slide valve 500 narrows for a short period of time the cross section of suction duct 598 in the direction of arrow H. The throttle slide valve 500 is actuated by the actuating arm 585 of the mobile servicing device 52 during the preliminary feeding operation. A mounting 596 is provided for the suction duct 598 and throttle slide valve, as part of a housing.

In practicing certain preferred embodiments of the invention, it is not absolutely necessary to reduce the vacuum present in the spinning rotor 7 merely during the preliminary feeding operation. The temporal control can be substantially simplified by lowering the vacuum during the entire piecing process, so that during this time the fibers are fed at a speed which is lower than in the normal operation. It is important that the fibers 291 are immediately accelerated and thereby stretched at the impingement point 290 of the fiber-collecting surface 289, even in case of a reduced rotor speed, to avoid the formation of "bird's nests".

Figure 6:
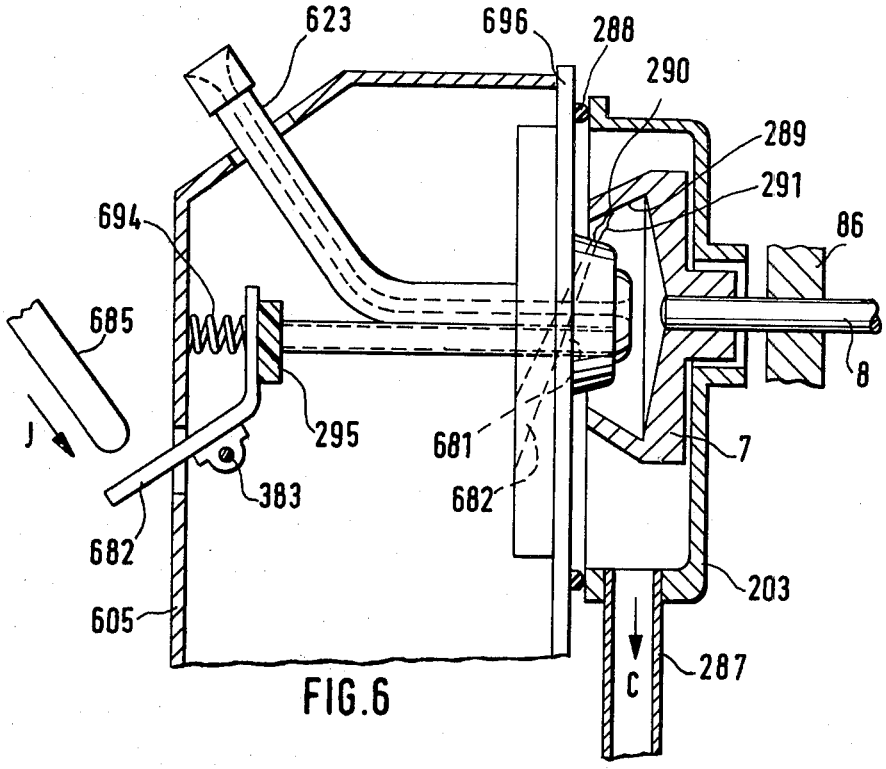
FIG. 6 is a view similar to FIG. 2 and showing yet another preferred embodiment of the present invention.

The embodiment of FIG. 6 corresponds essentially to that of FIG. 2, except that the ventilating aperture 681 terminates in the interior of the spinning rotor 7. The associated sealing pressure element 295 here again is mounted to a two-armed lever 682 pivotable against the pressure of spring 694. A lever 685, adjustable in the direction of arrow J are mounted to the piecing device, serves as the actuating element. Also this embodiment provides dual effects, namely firstly the flushing action to remove the "errant" fibers and secondly a slowing down of the preliminarily fed fibers 291. The FIG. 6 embodiment incudes a yarn take-off duct 623 and mounting part 696 carried by housing 605.

While we have shown and described several embodiments in accordance with the present invention, it is understood that the same is not limited thereto but is susceptible to numerous changes and modifications as known to those skilled in the art and we therefore do not wish to be limited to the details shown and described herein but intend to cover all such changes and modifications as are encompassed by the scope of the appended claims.

We claim:

1. Open-end spinning machine comprising a spinning unit including:

a spinning rotor, opening means for opening fibers, fiber feed means for feeding fibers from said opening means to said spinning rotor, vacuum source means for generating an air current which acts on said fibers to aid in feeding said fibers through said fiber feed means, piecing apparatus including means for returning a thread end into the rotor for piecing onto a fiber ring deposited therein and for taking off the thus pieced thread, said piecing apparatus being equipped with additional devices for affecting the rotor speed and the quantity of fed fibers during the piecing step, and additional air flow control means for controlling the air current produced by said vacuum source means at the fiber feed means during the piecing operation, whereby the transport of the fibers from the opening means to the spinning rotor can be influenced.

2. Open-end spinning machine according to claim 1, wherein the spinning rotor is accommodated in a housing connected to said vacuum source means, and wherein the air flow control means includes ventilating means connected to the housing of the spinning rotor, these ventilating means comprising sealing elements selectively actuatable from outside.

3. Open-end spinning machine according to claim 2, wherein the ventilating means are located in the zone of the housing lying in opposition to the open side of the spinning rotor.

4. Open-end spinning machine according to claim 1, wherein connecting the line means are provided between a cover of the spinning rotor and the vacuum source means, and wherein the air flow control means includes vent apertures comprising sealing elements selectively actuatable from the outside.

5. Open-end spinning machine according to claim 1, wherein said vacuum source means includes vacuum line means leading to a housing surrounding the spinning rotor or to a cover of the spinning rotor, and wherein the air flow control means includes a throttle valve arranged in said vacuum line means, said throttle valve being selectively adjustable from outside of the spinning unit.

6. Open-end spinning machine according to claim 1, wherein the piecing apparatus for conducting the piecing operation is constituted by a mobile, traveling device containing an actuating element selectively actuable to control sealing elements of said air flow control means.

7. Open-end spinning machine according to claim 1, wherein a plurality of said spinning units are provided in side-by-side relationship, said spinning units being driven by common drive means.

8. Open-end spinning machine according to claim 7, wherein the piecing apparatus for conducting the piecing operation is constituted by a mobile, traveling device containing an actuating element selectively actuable to control sealing elements of said air flow control means.

9. Open-end spinning machine according to claim 7, wherein the spinning rotors are accommodated in respective housings connected to said vacuum source means, and wherein the air flow control means includes ventilating means connected to each of the housings of the spinning rotors, these ventilating means comprising sealing elements selectively actuable from outside of the housings.

10. Open-end spinning machine according to claim 9, wherein the ventilating means are located in the zone of the respective housings lying in opposition to the respective open side of the associate spinning rotor.

11. Open-end spinning machine according to claim 7, wherein connecting line means are provided between covers of the spinning rotors and the vacuum source means, and wherein the air flow control means includes respective vent apertures for each spinning unit, said vent apertures including sealing elements which are selectively actuable from outside the spinning units.

12. Open-end spinning machine according to claim 7, wherein said vacuum source means includes vacuum line means leading to respective housings surrounding the respective spinning rotors or to respective covers of the respective spinning rotors, and wherein the air flow control means includes throttle valves arranged in said vacuum line means at each of said spinning units, said throttle valve means being selectively adjustable from outside of the respective spinning units.

* * * * *